US011242492B2

(12) United States Patent
Pelaez et al.

(10) Patent No.: US 11,242,492 B2
(45) Date of Patent: Feb. 8, 2022

(54) METHODS OF TREATING TAILINGS

(71) Applicant: KEMIRA OYJ, Helsinki (FI)

(72) Inventors: Miguel Pelaez, Decatur, GA (US); Thomas Fenderson, Decatur, GA (US)

(73) Assignee: KEMIRA OYJ, Helsinki (FI)

( * ) Notice: Subject to any disclaimer, the term of this patent is extended or adjusted under 35 U.S.C. 154(b) by 26 days.

(21) Appl. No.: 16/438,856

(22) Filed: Jun. 12, 2019

(65) Prior Publication Data

US 2019/0375994 A1 Dec. 12, 2019

Related U.S. Application Data

(60) Provisional application No. 62/683,751, filed on Jun. 12, 2018.

(51) Int. Cl.

| | |
|---|---|
| ***C10G 33/06*** | (2006.01) |
| ***C10G 27/02*** | (2006.01) |
| ***C10G 1/04*** | (2006.01) |
| ***C10G 27/12*** | (2006.01) |
| ***C10G 29/20*** | (2006.01) |
| ***C10G 29/12*** | (2006.01) |

(52) U.S. Cl.

CPC ..... *C10G 33/06* (2013.01); *C10G 1/045* (2013.01); *C10G 27/02* (2013.01); *C10G 27/12* (2013.01); *C10G 29/12* (2013.01); *C10G 29/20* (2013.01); *C10G 2300/1003* (2013.01); *C10G 2300/202* (2013.01); *C10G 2300/206* (2013.01)

(58) Field of Classification Search

CPC . C10G 1/00; C10G 1/04; C10G 1/045; C10G 27/00; C10G 27/02; C10G 27/12; C10G 29/20; C10G 29/12; C10G 29/00; C10G 2300/1033; C10G 2300/206; C10G 2300/202

See application file for complete search history.

(56) References Cited

U.S. PATENT DOCUMENTS

| | | | | |
|---|---|---|---|---|
| 2014/0246376 A1* | 9/2014 | Berger | C02F 1/722 | 210/721 |
| 2015/0027929 A1* | 1/2015 | Watson | C10G 1/045 | 208/390 |
| 2018/0127290 A1* | 5/2018 | Utting | B01D 21/01 | |

* cited by examiner

*Primary Examiner* — Prem G Singh
*Assistant Examiner* — Brandi M Doyle
(74) *Attorney, Agent, or Firm* — Robin L. Teskin; Baker, Donelson, Bearman, Caldwell & Berkowitz PC

(57) ABSTRACT

The present embodiments generally relate to methods for the treatment of tailings, e.g., oil sands tailings, including methods comprising the use of one or more flocculants, one or more coagulants and one or more oxidants to treat said tailings and/or to improve the performance of said one or more flocculants.

24 Claims, 2 Drawing Sheets

SAMPLE 1 2 3 4 5 6 7

SAMPLE A B C D

METHODS OF TREATING TAILINGS

RELATED APPLICATIONS

This application claims benefit of priority to U.S. provisional application Ser. No. 62/683,751 filed Jun. 12, 2018, the contents of which are incorporated by reference in their entirety.

FIELD OF THE ART

The present disclosure generally relates to methods of treating tailings, e.g., methods comprising the dewatering of tailings, such as oil sands tailings.

BACKGROUND

Bituminous sands, also referred to as oil sands, are a type of petroleum deposit. Oil sands typically contain naturally occurring mixtures of sand, clay, water, and a dense, extremely viscous form of petroleum technically referred to as bitumen (or colloquially "tar" due to their similar appearance, odor, and color). Oil sands may be found in large quantities in many countries throughout the world, most abundantly so in Canada and Venezuela. Oil sand deposits in northern Alberta in Canada (Athabasca oil sands) are thought to contain approximately 1.6 trillion barrels of bitumen, and production from oil sands mining operations is expected to reach 1.5 million barrels of bitumen per day by 2020.

Oil sands reserves are an important part of the world's oil reserves, particularly as higher oil prices and new technology enable oil sands reserves to be profitably extracted and upgraded to usable products. Oil sands are often referred to as unconventional oil or crude bitumen, in order to distinguish the bitumen extracted from oil sands from the free-flowing hydrocarbon mixtures known as crude oil traditionally produced from oil wells.

Conventional crude oil may be extracted from the ground by drilling oil wells into a petroleum reservoir and allowing oil to flow into them under natural reservoir pressure, although artificial lift and techniques such as water flooding and gas injection may be required to maintain production as reservoir pressure drops toward the end of a field's life. Since extra-heavy oil and bitumen flow very slowly, if at all, towards producing wells under normal reservoir conditions, the sands may be extracted by strip mining or the oil made to flow into wells by in situ techniques that reduce the viscosity, such as by injecting steam, solvents, and/or hot air into the sands. These processes may use more water and may require larger amounts of energy than conventional oil extraction, although many conventional oil fields also typically require large amounts of water and energy to achieve good rates of production.

Water-based oil sand extraction processes generally include ore preparation, extraction, and tailings treatment stages wherein a large volume of solids-laden aqueous tailings may typically be produced. The hot tailing stream generally comprises sand, clays, residual bitumen and persistent amounts of toxic soluble organic compounds that originate from the extraction process, nonlimiting examples of which include, for example, carboxylates, sulfonates and naphthenates. Due to the amount of oil extraction in locations such as Canada and Venezuela, large storage facilities may be needed for these tailings.

In some instances, treatment of tailings streams may generally comprise the use of flocculants. Flocculants, or flocculating agents, are chemicals that promote flocculation by causing colloids and other suspended particles in liquids to aggregate, thereby forming a floc. Flocculants are generally used in water treatment processes to improve the sedimentation or filterability of small particles. Flocculants that have been used in treatments for dewatering oil sands tailings include polyacrylamide polymer flocculants. Methods of the treatment of tailings, for example during flocculation, such that removal of persistent organics may be achieved, is highly desirable in the industry.

BRIEF SUMMARY

The present embodiments generally relate to a method of treating tailings, which method comprises adding to a tailings stream one or more flocculants, one or more oxidants, and one or more coagulants. In exemplary embodiments, said method may further comprise removal of one or more organic contaminants from the tailings stream. In exemplary embodiments, said tailings may comprise oil sands tailings and/or mature fine tailings. In some embodiments, said method may further comprise removal of one or more toxic contaminants from the tailings stream. Furthermore, said one or more flocculants, one or more oxidants, and one or more coagulants may be added separately and/or sequentially to the tailings in some embodiments. In some embodiments, said (i) one or more flocculants, (ii) one or more oxidants and (iii) one or more coagulants are combined and/or may be added simultaneously to the tailings. Additionally, in some embodiments, said one or more oxidants may comprise at least one oxygen bleaching agent. In some embodiments, said one or more coagulants may comprise a coagulant which catalyzes or promotes the effect of the one or more oxidants. Moreover, in some embodiments of said method may improve flocculation by enhancing breakdown of the polymer/flocs. In some embodiments, said one or more flocculants may comprise at least one high molecular weight polymer flocculant. In exemplary embodiments, said removal of one or more organic contaminants may comprise oxidation of said one or more organic contaminants. In some embodiments, said one or more oxidants may comprise one or more peroxide-containing compounds. In some embodiments, said one or more oxidants may comprise, but is not limited to comprising any one or more of the following: calcium peroxide, fluorine, hydroxyl radical, sulfate radical, persulfate anion, sodium percarbonate, permanganate, peroxysulfuric acid, ozone, hypochlorite, and/or chlorine dioxide. In an exemplary embodiment, said one or more oxidants may comprise calcium peroxide. In some embodiments, said method may result in the generation and release of hydrogen peroxide. In some embodiments, said method may result in the generation and release of hydrogen peroxide which is regulated by the rate of calcium peroxide dissolution. In some embodiments, said one or more coagulants may comprise one or more iron-containing compound, such as, but not limited to, ferrous chloride, ferric chloride, ferrous sulfate, ferric sulfate, and/or polyferric sulphate. In an exemplary embodiment, said one or more coagulants may comprise ferrous chloride.

Exemplary embodiments of the present disclosure also generally relate to methods of treating tailings, wherein said one or more organic contaminants may comprise any form of organic contaminant present in said tailings, such as, for example, carboxylates, sulfonates, and/or naphthenates. In some embodiments, said one or more flocculants may comprise one or more anionic, one or more nonionic, and/or one or more cationic monomers. In some embodiments, said one or more flocculants may comprise one or more acrylamide monomers. Moreover, in some embodiments, said one or more flocculants may comprise one or more anionic polymers, one or more cationic polymers, and/or one or more nonionic polymers. In some embodiments, treatment of tailings in accordance with the methods discussed herein may result in water that is reusable in bitumen extraction, or requirements necessary for discharge back to the environment.

Furthermore, in some embodiments said one or more coagulants may comprise a transition metal. In some embodiments, said transition metal may act as a catalyst for activation of said oxidant. In further embodiments of said method, treatment of said tailings may result in a reduction of chemical oxygen demand ("COD"), for example, said treatment may produce a treated tailings stream having a COD of about 500 mg/L or less, about 450 mg/L or less, about 400 mg/L or less, about 350 mg/L or less, about 300 mg/L or less, about 250 mg/L or less, about 200 mg/L or less, about 190 mg/L, about 180 mg/L or less, about 170 mg/L or less, or about 162 mg/L or less. In some embodiments, said treatment may reduce the molecular weight of said one or more flocculants. Moreover, in some embodiments, said treatment may reduce the turbidity (solids content) of said tailings, for example, said treatment may produce a treated tailings stream having a turbidity of about 400 FAU or less, about 375 FAU or less, about 350 FAU or less, about 325 FAU or less, about 300 FAU or less, about 275 FAU or less, about 250 FAU or less, about 225 FAU or less, about 200 FAU or less, about 175 FAU or less, about 150 FAU or less, about 125 FAU or less, about 100 FAU or less, about 75 FAU or less, about 50 FAU or less, or about 25 FAU or less. In exemplary embodiments, said one or more flocculants may be present at a concentration that produces a desired result. In further exemplary embodiments, said one or more oxidants and/or said one or more coagulants may be added to said tailings at an amount that produces a desired result. In exemplary embodiments, said treatment may result in a lower overall toxicity of said tailings. In some embodiments, said treatment may provide longer oxidation potential during settling of solids after flocculation.

In some embodiments, said one or more oxidants and said one or more coagulants may be added directly to the tailings. In some embodiments, said one or more oxidants and said one or more coagulants may be added to a solution comprising said one or more flocculants, and the solution may be added to said tailings. Furthermore, in some embodiments, said one or more oxidants and said one or more coagulants may be added separately and/or sequentially to said tailings and/or to a solution comprising said one or more flocculants. In some embodiments, said one or more oxidants may be added before said one or more coagulants, or in some embodiments said one or more coagulants may be added before said one or more oxidants. In some embodiments, said one or more coagulants may be added to the tailings in multiple doses. Furthermore, in some embodiments, said one or more oxidants may be added to the tailings in multiple doses. In some embodiments, said one or more oxidants and said one or more coagulants may be combined and/or may be added simultaneously to said tailings and/or to a solution comprising said one or more flocculants. In some embodiments, said one or more oxidants may be added in a solid form and/or as a part of a solution or suspension to said tailings. In some embodiments, said one or more coagulants may be added in a solid form and/or as a part of a solution or suspension to said tailings.

In exemplary embodiments, treatment of said tailings may result in a trafficable deposit. In exemplary embodiments, said method may result in treated tailings that meet environmental regulatory limits related to the content of said organic contaminants in said treated tailings. In some embodiments, said tailings may comprise produced water and/or other operation streams, recycle water, wastewater, makeup water, make up well blowdown streams, pond water, water from deoiling operations, and/or any combination thereof. In some embodiments, treatment of said tailings further may comprise dewatering of said tailings. In some embodiments, said dewatering may comprise sedimentation of the treated tailings to produce a settled sediment. In some embodiments, said method may be carried out in a vessel, for example a gravimetric thickener, or in a settlement pond. In some embodiments, said dewatering may comprise pressure dewatering. In some embodiments, said pressure dewatering may comprise using a filter press, a belt press, or a centrifuge. In some embodiments, said method may result in a consolidation of said tailings, i.e., a reduction of volume of said tailings. Furthermore, in some embodiments, said one or more oxidants and said one or more coagulants may be applied to an aqueous suspension of particulate mineral material as said suspension is transferred as a fluid to the deposition area, an intermediate treatment area and/or once it has been transferred to the deposition area.

The present disclosure additionally generally encompasses a method of treating tailings which method may result in a trafficable deposit, wherein said method may comprise treating said tailings with an amount of one or more flocculants, one or more oxidants, and one or more coagulants that results in said trafficable deposit.

Additionally, the present disclosure generally relates to a composition comprising one or more flocculants, one or more coagulants, and one or more oxidants for use with the methods described herein. Furthermore, the present embodiments also generally relate to a composition suitable for use in treating tailings, e.g., oil sand tailings, comprising the combination of one or more coagulants, and one or more oxidants, wherein said combination elicits an additive or synergistic effect on the removal of toxic contaminants and/or promotes the breakdown of polymers and polymer/flocs added and produced during flocculation. In exemplary embodiments, said composition may further comprise one or more flocculants. In some embodiments, said one or more oxidants may comprise at least one oxygen bleaching agent. In some embodiments, said one or more coagulants may catalyze or may promote the effect of the one or more oxidants. In some embodiments, said (i) one or more flocculants, (ii) one or more oxidants and (iii) one or more coagulants may be provided as a mixture or blend. In exemplary embodiments, said one or more oxidants may comprise one or more peroxide-containing compounds comprising calcium peroxide, fluorine, hydroxyl radical, sulfate radical, persulfate anion, sodium percarbonate, permanganate, peroxysulfuric acid, ozone, hypochlorite, and/or chlorine dioxide. In an exemplary embodiment, said one or more oxidants may comprise calcium peroxide. In exemplary embodiments, said one or more coagulants may comprise one or more iron-containing compounds comprising ferrous chloride, ferric chloride, ferrous sulfate, ferric sulfate, and/or polyferric sulphate. In an exemplary embodiment, said one or more coagulants may comprise ferrous chloride. Additionally, the present embodiments generally encompass any product produced by any of the foregoing methods.

DETAILED DESCRIPTION

Figure 1:
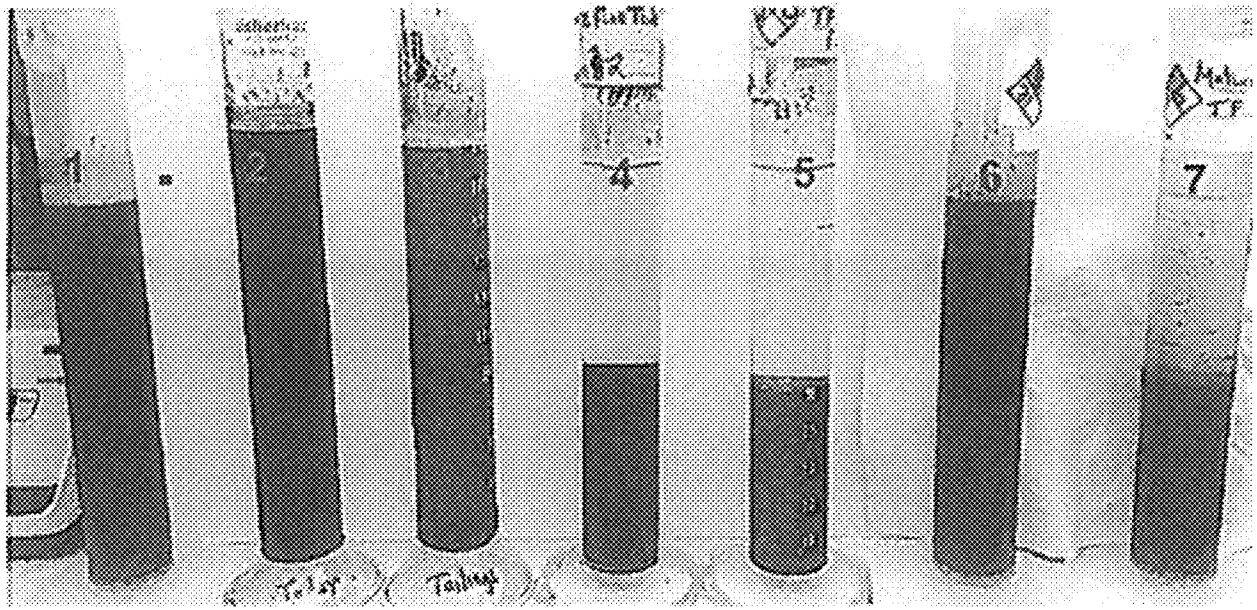
FIG. 1 shows the visible solid-liquid separation of a Mature Fine Tailings (MFT) sample treated with exemplary flocculants, and, in some instances, an exemplary oxidant and/or exemplary coagulant, in accordance with Example 1.

Disclosed herein are methods for treating tailings such as oil sands tailings. Some embodiments involve methods for flocculating solids in the tailings and/or methods for the dewatering of tailings. Various methods may generally comprise the use of one or more flocculants in order to flocculate solids from the tailings in combination with one or more coagulants and one or more oxidants. The methods generally may be used for solid-liquid separation of the oil sands tailings, e.g., in order to efficiently recycle water and to reduce the volume of tailings which may be transferred to a dedicated disposal area and/or a tailings pond. By using the methods described herein, a more complete separation of the solids from the water may be achieved, improving process efficiency relative to conventional processes for treating tailings streams. The methods described herein may be used to enhance settling of solids, especially fine and ultrafine solids and/or MFT, in tailings and particularly in oils sands and/or oil sands ore tailings streams. The methods may be readily incorporated into current processing facilities and may provide economic and environmental benefits. Furthermore, the methods may result in the removal of organic contaminants, such as through the oxidation of organic contaminants during flocculation of tailings. In some embodiments, treatment of said tailings using the methods may result in water that is reusable in other applications, for example, utility grade applications.

DETAILED DESCRIPTION

Definitions

As used herein the singular forms "a", "and", and "the" include plural referents unless the context clearly dictates otherwise. All technical and scientific terms used herein have the same meaning as commonly understood to one of ordinary skill in the art to which this invention belongs unless clearly indicated otherwise.

As used herein, the terms "tailings" and "tailings stream" generally refer to the discarded materials that may be generated in the course of extracting a valuable material from an ore. Generally, any mining or mineral processing operation that uses water to convey or wash materials will typically generate a tailings stream. Exemplary tailings include, but are not limited to, tailings from coal mining, copper mining, gold mining, and mineral processing, such as, for example, processing of phosphate, diamond, gold, mineral sands, zinc, lead, copper, sliver, uranium, nickel, iron ore, coal, oil sands, and/or red mud. Exemplary tailings also include tailings from the processing of oil sands. While many of the embodiments are described with reference to oil sands tailings, it is understood that the embodiments, including compositions, processes, and methods, are not limited to applications in oil sands tailings, but also can be applied to various other tailings. The term tailings is meant to be inclusive of but not limited to any of the types of tailings discussed herein, for example, process oil sand tailings, in-process tailings, oil sands tailings, and the like.

The terms "process oil sand tailings", "oil sands tailings stream", "oil sands process tailings", or "oil sands tailings", generally refer to tailings that may be generated as bitumen is extracted from oil sands. In tar sand processing, tailings may comprise the whole tar sand ore and any net additions of process water less the recovered bitumen.

Any tailings fraction obtained from the process, such as tailings from primary separation cell, primary flotation and secondary flotation, process tailings, froth treatment tailings, and mature fine tailings or combination thereof, may be treated by the exemplary processes described herein. The tailings may comprise a colloidal sludge suspension comprising clay minerals and/or metal oxides/hydroxides. In exemplary embodiments, the tailings stream may comprise water and solids.

Tailings generally comprise mineral solids having a variety of particle sizes. Mineral fractions with a particle diameter greater than 44 microns may be referred to as "coarse" particles, or "sand." Mineral fractions with a particle diameter less than 44 microns may be referred to as "fines" and may essentially be comprised of silica and silicates and clays that may be easily suspended in the water. Ultrafine solids (<2 μm) may also be present in the tailings stream and may be primarily composed of clays. The tailings may include but are not limited to including one or more of the coarse particles, fine tailings, MFT, FFT, or ultrafine solids.

The oil sands tailings may additionally include but are not limited to including one or more of any of the tailings streams that may be produced in a process to extract bitumen from an oil sands ore. In some embodiments, the tailings may comprise paraffinic or naphthenic tailings, for example paraffinic froth tailings. The tailings may be combined into a single tailings stream for dewatering or each tailings stream may be dewatered individually.

In some embodiments, the tailings stream may be produced from an oil sands ore and may comprise water and solids, for example sand and fines. In exemplary embodiments, the tailings stream, for example, an oil sands tailings stream, may comprise at least one of coarse tailings, fluid fine tailings, MFT, fine tailings, and ultrafine tailings. In some embodiments, the processes may be used to treat ultrafine solids. In some embodiments, the tailings stream, for example, an oil sands tailings stream, may comprise a fines (particle size <44 μm) content of about 10 to about 100 wt %, about 20 to about 100 wt %, about 30 to about 100 wt %, or about 40 to about 90 wt % of the dry tailings. In some embodiments, the tailings stream may comprise about 0.01 to about 5 wt % of bitumen. In some embodiments, the oil sands ore tailings stream may comprise process tailings.

Any of the above terms referencing "tailings" additionally generally comprises fluid fine tailings ("FFT") such as mature fine tailings ("MFT") from tailings ponds and fine tailings from ongoing extraction operations (for example, froth treatment tailings or thickener underflow) which may bypass a tailings pond.

As used herein, "fines" generally may refer to mineral fractions that may comprise a particle diameter less than 44 microns.

As used herein, "fluid fine tailings" or "FFT" may comprise a liquid suspension of oil sand fines in water with a solids content greater than 2%.

The term "mature fine tailings" ("MFT") generally may refer to fine tailings that may comprise a solids content of about 30-35%, and that generally may comprise almost entirely solids <44 microns. MFT generally may behave as a fluid-like colloidal material. MFT may comprise FFT with a low sand to fines ratio ("SFR"), i.e., generally less than about 0.3, and a solids content that may be generally greater than about 30%.

As used herein, "sand" generally may refer to mineral fractions that may comprise a particle diameter greater than 44 microns.

As used herein, the term "iron" generally refers to any form of iron, for example, iron of any isotopic state, iron of any oxidation state, any form of an iron compound, such as, for example, iron (III) chloride, iron (II) chloride (also known as ferrous chloride), iron (III) chloride hexahydrate, and iron sulfate. For example, iron chloride as used herein may generally refer to both ferrous chloride and ferric chloride, and iron sulfate generally refers to ferrous sulfate and ferric sulfate, so long as use of either form in any of the methods described herein attains a desired result.

As used herein, the term "coagulant" generally may refer to an agent that may typically destabilize colloidal suspensions. Exemplary coagulants may comprise iron-based coagulants, such as ferrous chloride, and/or ferric chloride. Additional examples of iron-based coagulants may include, but are not limited to including ferrous chloride, ferric chloride, ferrous sulfate, ferric sulfate, and/or polyferric sulphate. Other coagulants may be added in addition to an iron based coagulant, and said other coagulants may comprise but are not limited to comprising inorganic coagulants such as aluminium sulfate ("ALS") and other metal sulfates and gypsum, organic coagulants such as polyamines and polyDADMACs, and other inorganic and organic coagulants known in the art. In some embodiments, the coagulant may comprise a combination or mixture of one or more iron-based coagulants with one or more other coagulants, e.g., one or more organic coagulants and/or with one or more inorganic coagulants. In some embodiments, said other coagulant may comprise a poly(diallyldimethyl ammonium chloride) ("polyDADMAC") compound; an epi-polyamine compound; a polymer that may comprise one or more quaternized ammonium groups, such as acryloyloxyethyltrimethylammonium chloride, methacryloyloxyethyltrimethylammonium chloride, methacrylamidopropyltrimethylammonium chloride, acrylamidopropyltrimethylammonium chloride; or a mixture thereof. In some embodiments, one or more inorganic coagulants may be added to the tailings stream in addition to one or more iron-based coagulants. An inorganic coagulant may, for example, reduce, neutralize or invert electrical repulsions between particles. Said inorganic coagulants may comprise but are not limited to inorganic salts such as aluminum chloride, aluminum sulfate, aluminum chlorohydrate, polyaluminum chloride, polyaluminum silica sulfate, lime, calcium chloride, calcium sulfate, magnesium chloride, sodium aluminate, various commercially available aluminum salt coagulants, or combinations thereof. In some embodiments, the coagulant may comprise a combination or mixture of one or more iron-based coagulants with one or more of any of the above coagulants. In some embodiments, a coagulant to be used with the compositions, methods, and processes described herein may comprise an iron-based coagulant and additionally may comprise ALS. In some embodiments, a coagulant to be used with the compositions, methods, and processes described herein may provide synergistic benefits when used in conjunction with exemplary flocculants and oxidants as described herein.

As used herein, the terms "oxidant" and "oxidizer" generally refer to any agent that has the ability to oxidize other substances, that is, to cause said other substance to lose electrons. Exemplary oxidants may comprise a peroxide-containing compound, such as, for example, calcium peroxide. Exemplary oxidants may comprise $CaO_2$. In some embodiments, an oxidant may comprise, but is not limited to comprising, any one or more of the following: fluorine, hydroxyl radical, sulfate radical, persulfate anion, sodium percarbonate, permanganate, peroxysulfuric acid, ozone, hypochlorite, chlorine dioxide, or any combination thereof where applicable. In some embodiments, said oxidant may include at least one oxygen bleaching agent.

As used herein the term "nonionic monomer" generally refers to a monomer that possesses a neutral charge. Exemplary nonionic monomers may comprise but are not limited to comprising monomers selected from the group consisting of acrylamide ("AMD"), methacrylamido, vinyl, allyl, ethyl, and the like. Some exemplary nonionic monomers may be substituted with a side chain selected from, for example, an alkyl, arylalkyl, dialkyl, ethoxyl, and/or hydrophobic group. In an exemplary embodiment, a nonionic monomer may comprise AMD.

As used herein, the term "anionic monomers" may refer to either anionic monomers that are substantially anionic in whole or (in equilibrium) in part, at a pH in the range of about 6.0 to about 8.0. The "anionic monomers" may be neutral at low pH (from a pH of about 2 to about 6), or to anionic monomers that are anionic at low pH.

Additional examples of anionic monomers may comprise but are not limited to comprising acrylic, methacrylic, maleic monomers and the like, additional examples include but not limited to any monomer substituted with a carboxylic acid group or salt thereof. In some embodiments, anionic monomers which may be substituted with a carboxylic acid group include, for example, acrylic acid, and methacrylic acid. In some embodiments, an anionic monomer may be a (meth)acrylamide monomer wherein the amide group has been hydrolyzed to a carboxyl group. Said monomer may be a derivative or salt of a monomer according to the embodiments. Additional examples of anionic monomers comprise but are not limited to comprising sulfonic acids or a sulfonic acid group, or both. In some embodiments, the anionic monomers may comprise a sulfonic function that may comprise, for example, 2-acrylamido-2-methylpropane sulfonic acid ("AMPS") or acrylamide tertiary butyl sulfonic acid ("ATBS").

As used herein, the term "cationic monomer" generally refers to a monomer that possesses a positive charge. Examples of cationic monomers may comprise but are not limited to comprising acryloyloxy ethyl trimethyl ammonium chloride ("AETAC"), methacryloyloxyethyltrimethylammonium chloride ("MAETAC"), methacrylamidopropyltrimethylammonium chloride ("MAPTAC"), dimethylaminoethyl methacrylate ("DMAEMA"), acrylamidopropyltrimethylammonium chloride ("APTAC").

Examples of cationic monomers may also comprise but are not limited to comprising dialkylaminoalkyl acrylates and methacrylates, e.g., dimethylaminoethyl methacrylate ("DMAEMA"), and their quaternary or acid salts, including, but not limited to, dimethylaminoethyl acrylate methyl chloride quaternary salt, dimethylaminoethyl acrylate methyl sulfate quaternary salt, dimethyaminoethyl acrylate benzyl chloride quaternary salt, dimethylaminoethyl acrylate sulfuric acid salt, dimethylaminoethyl acrylate hydrochloric acid salt, diethylaminoethyl acrylate, methyl chloride quaternary salt, dimethylaminoethyl methacrylate methyl chloride quaternary salt, dimethylaminoethyl methacrylate methyl sulfate quaternary salt, dimethylaminoethyl methacrylate benzyl chloride quaternary salt, dimethylaminoethyl methacrylate sulfuric acid salt, dimethylaminoethyl methacrylate hydrochloric acid salt, dimethylaminoethyl methacryloyl hydrochloric acid salt, dialkylaminoalkylacrylamides or methacrylamides and their quaternary or acid salts such as dimethylaminopropyl acrylamide methyl sulfate quaternary salt, dimethylaminopropyl acrylamide sulfuric acid salt, dimethylaminopropyl acrylamide hydrochloric acid salt, dimethylaminopropyl methacrylamide methyl sulfate quaternary salt, dimethylaminopropyl methacrylamide sulfuric acid salt, dimethylaminopropyl methacrylamide hydrochloric acid salt, diethylaminoethylacrylate, diethyl aminoethylmethacrylate and diallyldialkylammonium halides such as diallyldiethylammonium chloride and diallyldimethyl ammonium chloride ("DADMAC"). Alkyl groups may generally be $C_{1-8}$ alkyl.

As used herein, the terms "polymer," "polymers," "polymeric," and similar terms are used in their ordinary sense as understood by one skilled in the art, and thus may be used herein to refer to or describe a large molecule (or group of such molecules) that may comprise recurring units. Polymers may be formed in various ways, including by polymerizing monomers and/or by chemically modifying one or more recurring units of a precursor polymer. Unless otherwise specified, a polymer may comprise a "homopolymer" that may comprise substantially identical recurring units that may be formed by, for example, polymerizing, a particular monomer. Unless otherwise specified, a polymer may also comprise a "copolymer" that may comprise two or more different recurring units that may be formed by, for example, copolymerizing, two or more different monomers, and/or by chemically modifying one or more recurring units of a precursor polymer. Unless otherwise specified, a polymer or copolymer may also comprise a "terpolymer" which generally refers to a polymer that comprises three or more different recurring units. Any one of the one or more polymers discussed herein may be used in any applicable process, for example, as a flocculant.

As used herein, the term "flocculant" may generally refer to a reagent that may bridge neutralized or coagulated particles into larger agglomerates, typically resulting in more efficient settling. In exemplary embodiments, the flocculant may comprise any one or more of the polymers and/or any one of the compositions discussed herein, for example, one or more polymers comprising one or more anionic, one or more cationic, and/or one or more nonionic monomers. In exemplary embodiments, the flocculant may comprise AMD. In some embodiments, one or more flocculants may comprise a low molecular weight, a medium molecular weight, and/or a high molecular weight. In some embodiments, one or more flocculants may comprise a low charge, a medium charge, and/or a high charge.

As used herein, the term "produced water" generally refers to any aqueous fluids produced during any type of industrial process, for example, an oil or gas extraction or recovery process, or any portion thereof. Typically the produced water may be obtained during an industrial process involving the use of water, generally copious amounts of water, wherein the end product of such industrial process may be an aqueous material or "produced water" which may be of an undesirable purity. Produced water may be generated during processes or portions thereof which involve oil sands.

As used herein, the terms "polyacrylamide" or "PAM" generally refer to polymers and co-polymers comprising acrylamide moieties, and the terms encompass any polymers or copolymers comprising acrylamide moieties, e.g., one or more acrylamide (co)polymers. Furthermore, PAMs may comprise any of the polymers or copolymers discussed herein. Additionally, the PAMs described herein, e.g., one or more acrylamide (co)polymers, may be provided in one of various forms, including, for example, dry (powder) form (e.g., DPAM), water-in-oil emulsion (inverse emulsion), suspension, dispersion, or partly hydrolyzed (e.g., HPAM, in which some of the acrylamide units have been hydrolyzed to acrylic acid). In exemplary embodiments, PAMs, e.g., one or more acrylamide (co)polymers, may be used for polymer flooding. In exemplary embodiments, flocculants comprising one or more PAMS may be used in any tailings treatment technique.

As used herein, the term "trafficable deposit" generally refers to a solid or semi-solid material that has been deposited on or over a surface. A trafficable deposit preferably has a minimum undrained shear strength of 5 kPa one year after deposition, and a minimum undrained shear strength of 10 kPa five years after deposition. A trafficable deposit may be produced according to any of the methods described herein.

METHODS

Disclosed herein are methods for treating tailings such as oil sands tailings. Some embodiments involve methods for flocculating solids in the tailings and/or methods for the dewatering of tailings. The various methods may generally comprise the use of one or more flocculants in order to flocculate solids from the tailings, in combination with one or more coagulants, and one or more oxidants. The various methods generally may be used in a solid liquid separation of oil sands tailings, e.g., in order to efficiently recycle water and to reduce the volume of tailings solids which need to be handled, such as by transferring to a dedicated disposal area and/or a tailings pond. By using the methods described herein, a more complete separation of the solids from the water may be achieved, improving process efficiency relative to conventional processes for treating tailings streams. The methods described herein may be used to enhance settling of solids, especially fine and ultrafine solids and/or MFT, in tailings and particularly in oil sands and/or oil sands ore tailings streams. The methods may be readily incorporated into current processing operations and may provide economic and/or environmental benefits. Furthermore, the methods may result in the removal of organic contaminants during flocculation of tailings, such as through the oxidation of said organic contaminants during said flocculation of tailings. In some embodiments, treatment of tailings using the methods may result in water that is reusable in other applications, for example, utility grade applications. Additionally, the present disclosure generally relates to any product that may be produced by any of the methods described herein, and to any composition comprising one or more flocculants, one or more coagulants, and one or more oxidants for use with any of the methods described herein.

In the various embodiments described herein, tailings to be treated may comprise oil sands tailings. In some embodiments, said tailings may comprise mature fine tailings. The tailing streams may further include one or more contaminants.

According to the various embodiments, a method for treating the tailings comprises adding to the tailings stream one or more flocculants. Said one or more flocculants may comprise one or more polymers, such as, for example, one or more polymers comprising one or more anionic monomers, one or more cationic monomers, and/or one or more nonionic monomers. In some embodiments, one or more flocculants may comprise acrylamide monomers. Moreover, one or more flocculants to be used in embodiments of the methods described herein may comprise one or more anionic polymers, cationic polymers, and/or nonionic polymers. Furthermore, said method may allow for the use of high molecular weight polymer flocculants.

In additional embodiments, treatment of tailings may comprise the addition of one or more flocculants to the tailings and may further comprise the addition of one or more oxidants and one or more coagulants. Said method may comprise the removal of organic contaminants from said tailings. According to the embodiments, the one or more coagulants may comprise any of the coagulants described herein, such as one or more iron-based coagulants. According to the embodiments, the oxidant may comprise any of the oxidants described herein, such as a peroxide containing compound, such as $CaO_2$. Said oxidant may comprise, but is not limited to comprising, any one or more of the following: calcium peroxide, fluorine, hydroxyl radical, sulfate radical, persulfate anion, sodium percarbonate, permanganate, peroxysulfuric acid, ozone, hypochlorite, and/or chlorine dioxide. Said oxidant may further include at least one oxygen bleaching agent. In embodiments, the methods may comprise use of one or more of said coagulants, e.g., one or more iron-based coagulants such as ferrous chloride, which may catalyze or promote the effect of one or more oxidants. In some embodiments, said method may result in the generation and release of hydrogen peroxide. In further embodiments, said method may result in the generation and release of hydrogen peroxide which is regulated by the rate of calcium peroxide dissolution when practicing the methods of the present disclosure. In some embodiments, said coagulant may comprise an iron containing compound, such as ferrous chloride. Said coagulant may comprise, but is not limited to comprising, any one or more of the following: ferrous chloride, ferric chloride, ferrous sulfate, ferric sulfate, and/or polyferric sulphate. In some embodiments, said oxidant and/or said coagulant may be added in a solid form or liquid form, such as a part of a solution or suspension. In the methods described herein said coagulant and said oxidant may be added simultaneously or separately, in combination, or sequentially. When added separately and sequentially, either the coagulant may be added first or the oxidant may be added first. In some embodiments, there may be a plurality of additions of the one or more oxidants and/or a plurality of additions of the one or more coagulants. According to the various embodiments, the order of addition and number of additions of each of the oxidant and/or the coagulant may be any order and/or number of additions that achieves a desired result. In embodiments, the combined use of said (i) one or more flocculants, (ii) one or more oxidants and (iii) one or more coagulants may improve flocculation of the solids by enhancing breakdown of the polymer/flocs. In some embodiments, two or more of said (i) one or more flocculants, (ii) one or more oxidants and (iii) one or more coagulants may be provided as a mixture or blend.

According to the various embodiments, methods for the treatment of tailings may comprise the removal and/or oxidation of organic contaminants present in the tailings stream. Said organic contaminants may comprise any form of organic contaminant present in the tailings to be treated. Non-limiting examples of said organic contaminants include carboxylates, sulfonates, and/or naphthenates. Treatment of said tailings according to embodiments described herein may result in water that is reusable for various applications, such as, for example, utility grade applications, or processing operations such as bitumen extraction. Treatment of said tailings according to embodiments described herein may result in water that satisfies requirements necessary for discharge back to the environment.

In some embodiments, a coagulant that may be used in accordance with methods described herein may comprise one or more transition metals. In said embodiments, said transition metal may act as a catalyst for activation of an oxidant to be used in accordance with the present methods. In some embodiments, said transition metal may be iron. In some embodiments, said transition metal may comprise an element whose atom has a partially filled d sub-shell, or which can give rise to cations with an incomplete d sub-shell. In some embodiments, said transition metal may comprise any element in the d-block of the periodic table, which includes groups 3 to 12 on the periodic table. Furthermore, said transition metal may comprise an element of the f-block lanthanide and actinide series.

In some embodiments, treatment of said tailings according to the methods disclosed herein may result in a reduction of chemical oxygen demand ("COD"). For example, the method may result in a COD of about 500 mg/L or less, about 450 mg/L or less, about 400 mg/L or less, about 350 mg/L or less, about 300 mg/L or less, about 250 mg/L or less, about 200 mg/L or less, about 190 mg/L, about 180 mg/L or less, about 170 mg/L or less, or about 162 mg/L or less after treatment of said tailings. Moreover, treatment of tailings using the present methods may result in a lower turbidity (solids content) of said tailings. For example, said treatment method may result in a turbidity of about 400 FAU or less, about 375 FAU or less, about 350 FAU or less, about 325 FAU or less, about 300 FAU or less, about 275 FAU or less, about 250 FAU or less, about 225 FAU or less, about 200 FAU or less, about 175 FAU or less, about 150 FAU or less, about 125 FAU or less, about 100 FAU or less, about 75 FAU or less, about 50 FAU or less, or about 25 FAU or less after treatment of said tailings.

In some embodiments, treatment of tailings according to the present methods may result in a break down of one or more flocculants, that is, at the end of the treatment method said flocculants may comprise a lower molecular weight relative to their original molecular weight prior to or at the time of addition. In some embodiments, the one or more flocculants may be added to provide a flocculant concentration that produces a desired result. Likewise, in some embodiments, the one or more oxidants and one or more coagulants, may be added to provide an oxidant concentration and/or a coagulant concentration that produces a desired result. In some embodiments, said oxidant and/or said coagulant may be added directly to the tailings to be treated. In some embodiments, said oxidant and/or said coagulant may be added to a solution comprising said one or more flocculants prior to addition to said tailings. In some embodiments, said oxidant and/or said coagulant may be added at separate times to said tailings and/or to a solution comprising said one or more flocculants. In some embodiments, said oxidant and said coagulant may be added simultaneously to said tailings and/or to a solution comprising said one or more flocculants.

In embodiments, the method for treatment of tailings may result in a lower overall toxicity of said tailings. Treatment of tailings according to the present methods may provide longer oxidation potential during settling of solids after flocculation, i.e., in some embodiments, longer periods of oxidation as settling occurs may be achieved due to the use of solid calcium peroxide, which may continue to produce a peroxide such as $H_2O_2$ as compared to the use of other oxidizers which may react more rapidly in some instances.

In embodiments said treatment methods may result in treated tailings that meet environmental regulatory limits related to the content of organic contaminants contained in said treated tailings. In some embodiments, the tailings to be treated may comprise produced water and/or other operation streams, recycle water, wastewater, makeup water, make up well blowdown streams, pond water, water from deoiling operations, and/or any combination thereof.

In some embodiments, said treatment methods may result in a trafficable deposit that may comprise mature fine tailings. A trafficable deposit may comprise a deposit typically created through a process involving self-weight consolidation, drying, enhanced drainage, and/or capping with minimum undrained shear strength of 5 kPa one year after deposition. Said trafficable surface layer desirably may have a minimum undrained shear strength of 10 kPa five years after active deposition. In various embodiments, a trafficable deposit may comprise the product of any methods of treating tailings after dewatering and/or drying.

The methods described herein may be used in conjunction with one or more dewatering processes and/or methods. In some embodiments, tailings may be treated according to any of the methods discussed herein, and the treated tailings may be dewatered by any known dewatering method. For example, dewatering may comprise sedimentation of the treated tailings to produce a settled sediment. Such a process may be carried out in a vessel, for example, a gravimetric thickener, or in a settlement pond. Alternatively, a dewatering process may comprise pressure dewatering, for example, using a filter press, a belt press, or a centrifuge. In some embodiments, the methods may result in a consolidation of the tailings, i.e., a reduction of volume of the tailings According to various methods described herein, the one or more oxidants, e.g., a peroxide containing compound, and one or more coagulants e.g., iron-based coagulants, as well as one or more flocculants, may be applied to an aqueous tailings suspension comprising particulate mineral material as the tailings stream is transferred as a fluid to the deposition area, an intermediate treatment area and/or once it has been transferred to a deposition area according to some embodiments. By deposition area it is meant any area where the aforementioned particulate material can be deposited. This can for instance be any subaerial area where waste is deposited from a mineral processing operation. Alternatively, it may be any area that has been excavated, for instance to extract useful material e.g. mineral values including bitumen, and in which the excavated area is filled with particulate material treated according to the methods described herein.

In some embodiments of the methods discussed herein, the tailings stream may be processed in a thickener, where suspended solids may be concentrated and the concentrated solid material will, for instance, leave the thickener as an underflow which may be pumped along a conduit to a deposition area. The conduit may be any means for transferring the material to the deposition area and may, for instance, be a pipe or a trench. Other means of mechanical treatment of the tailings include, but are not limited to including, the use of thin-lift deposition, filter presses, belt presses, and/or centrifuges.

The present embodiments also generally relate to a composition suitable for use in treating tailings, e.g., oil sand tailings, comprising the combination of one or more coagulants, and one or more oxidants. According to the various embodiments, the combination of one or more coagulants and one or more oxidants elicits an additive or synergistic effect on the removal of toxic contaminants in the tailings stream and/or promotes the breakdown of polymers and polymer/flocs added and produced during flocculation. In some embodiments, said composition may further comprise one or more flocculants. In some embodiments, said one or more oxidants may comprise at least one oxygen bleaching agent. In exemplary embodiments, said one or more coagulants may comprise one or more iron-based coagulants, e.g., ferrous chloride, and/or said one or more oxidants may comprise one or more peroxide-containing compounds, e.g., calcium peroxide. In some embodiments, said coagulant may catalyze or promote the effect of said oxidant. In further embodiments, said (i) one or more flocculants, (ii) one or more oxidants and (iii) one or more coagulants may be added to the tailings separately and/or sequentially and/or in combination. In some embodiments, said oxidant may comprise one or more peroxide-containing compounds comprising calcium peroxide, fluorine, hydroxyl radical, sulfate radical, persulfate anion, sodium percarbonate, permanganate, peroxysulfuric acid, ozone, hypochlorite, and/or chlorine dioxide. In some embodiments, said oxidant may comprise calcium peroxide. Also, in further embodiments, said coagulant may comprise one or more iron-based coagulants, for example, said iron-based coagulants may include ferrous chloride, ferric chloride, ferrous sulfate, ferric sulfate, and/or polyferric sulphate. In an embodiment, said coagulant may comprise ferrous chloride. Additionally, the present embodiments generally encompass any product produced by any of the foregoing methods.

The following examples are presented for illustrative purposes only and are not intended to be limiting.

EXAMPLES

Materials and Methods

MFT that contained 24.4% solids content was acquired from an active oil sands mining site in Canada. Produced water was also acquired from an active oil sands mining site in Canada. Said MFT and produced water were used to prepare the diluted MFT solutions described in the present Examples. First, the MFT was stirred vigorously from the bucket, transferred, and diluted with produced water when needed to make a solution with 12.2% solids content and a total volume of 250 ml total for each experiment.

Additionally, each polymer (flocculant) solution used in the present Examples was prepared with the same produced water as the diluted MFT. Exemplary flocculants used for the present Examples were anionic polyacrylamides with medium charge, medium molecular weight (Flocculant A), and medium charge, high molecular weight (Flocculant B).

A four-blade pitched impeller was used to stir each MFT solution. Next, the MFT solution was mixed at 400 rpm for 1 min in a 400 ml plastic beaker, followed by addition of a single dose of the flocculant dosage (specified in Table 1), followed by stirring for an additional minute. In some samples, a coagulant (ferrous chloride) and/or oxidant (calcium peroxide, $CaO_2$) was added to the solution, as specified in Table 1, in which case said coagulants and/or oxidants were added as a single dose one minute after the flocculant addition. Finally, each of the treated tailings solutions was transferred to a 250 ml graduated cylinder for visual inspection, turbidity measurement, and chemical oxygen demand (COD) measurement from supernatant after 24 h of settling. Both COD and turbidity were measured with a HACH® method. Initial conditions for the different experiments evaluating organic removal and flocculation of diluted MFT (12.2% solids) are presented in Table 1 below, and results are shown in Table 2.

TABLE 1

| Sample | Flocculant | Dosage | Oxidant ($CaO_2$) (ppm) | Coagulant (Ferrous Chloride) (ppm) |
|---|---|---|---|---|
| 1 | A | 400 ppm | — | — |
| 2 | A | 400 ppm | 40 | — |
| 3 | A | 400 ppm | 40 | 85 |
| 4 | A | 400 ppm | 80 | 170 |
| 5 | A | 400 ppm | 400 | 170 |
| 6 | B | 400 ppm | — | — |
| 7 | B | 400 ppm | 400 | 170 |

Example 1

Both Flocculant A alone and Flocculant B alone (see Table 1: Sample 1 and Sample 6) were able to flocculate the MFT at the dosage of 400 ppm (see Table 2), however, the turbidity and COD values remained high (see Table 2, wherein differences in turbidity and COD values from the sample supernatants are presented). With the addition of the oxidant calcium peroxide, along with Flocculant A, no significant changes were obtained in COD, and turbidity only slightly decreased (see Table 2: Sample 2). However, when both the coagulant ferrous chloride and the oxidant calcium peroxide were combined after flocculation of MFT, a significant decrease in both COD and turbidity was observed (see Table 2: Sample 3, Sample 4, and Sample 5). This effect was enhanced at higher concentrations of both coagulant (ferrous chloride) and oxidant (calcium peroxide), which suggested that there might be a higher capture of solids in the flocs formed and a reduction in the organic load in the supernatant obtained. The oxidant calcium peroxide reached a maximum at which point increasing the concentration did not appear to have an effect in the removal of COD and turbidity, for example, see Table 2: Sample 4 vs. Sample 5. FIG. 1 presents an image related to the visual difference between the samples in terms of settling bed and water quality of the supernatant that were obtained from the present Example.

TABLE 2

| Sample | COD (mg/L) | Turbidity (FAU) |
|---|---|---|
| 1 | 580 | 1290 |
| 2 | 550 | 890 |
| 3 | 220 | 324 |
| 4 | 190 | 23 |
| 5 | 200 | 26 |
| 6 | 450 | 1090 |
| 7 | 190 | 28 |

Example 2

In this example, two commercially-available flocculants (Flocculant A, and Flocculant C, which is a medium charge, low molecular weight ("MLMW") anionic polyacrylamide) were evaluated as part of tailings treatment compositions with and without oxidants and coagulants, in two different tailings substrates. The procedure described above was used in this example, with the following exceptions. In Samples A and B, the MFT sample was prepared (diluted) as described above, while in Samples C and D, the MFT was used in its undiluted form (24.4% solids). For Samples A and B, the polymer solutions were added to the tailings material to provide a concentration of 400 ppm (see FIG. 2, Table 3, and Table 4: Sample A and Sample B). In Samples C and D, the polymer solutions were added to the tailings substrate to provide a concentration of 1000 ppm.

Figure 2:
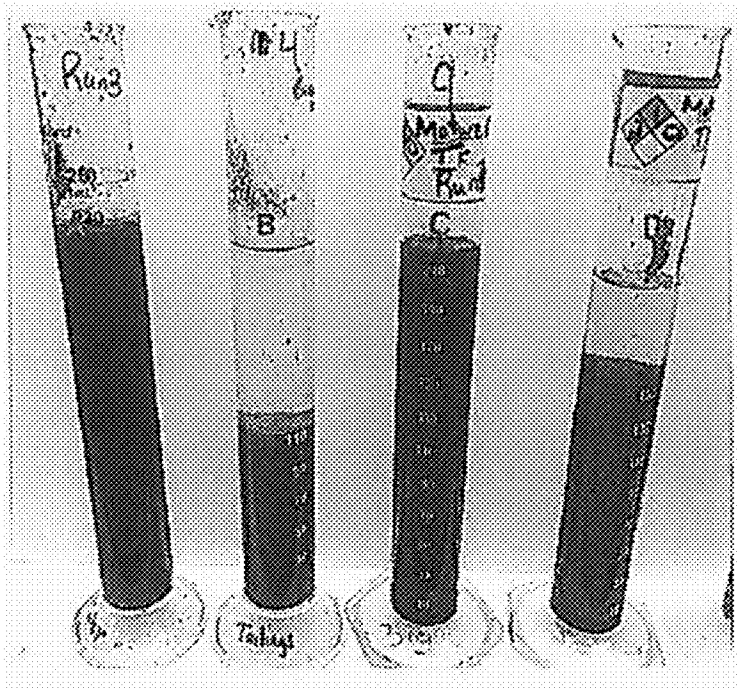
FIG. 2 shows the visible solid-liquid separation of a Mature Fine Tailings (MFT) sample treated with exemplary flocculants, and, in some instances, an exemplary oxidant and/or exemplary coagulant, in accordance with Example 2.

The results that were obtained in this Example are presented FIG. 2 and Table 4 and demonstrated a similar trend as compared to the other flocculants tested in the present Examples. These results indicated the potential of utilizing a wide variety of different anionic polymers for the treatment of oil sands tailings with the simultaneous enhancement of the water quality.

TABLE 3

| Sample | Flocculant | Flocculant Dosage (ppm) | Oxidant ($CaO_2$) (ppm) | Coagulant (Ferrous Chloride) |
|---|---|---|---|---|
| A | C | 400 | — | — |
| B | C | 400 | 80 | 170 |
| C | A | 1000 | — | — |
| D | A | 1000 | 5000 | 800 |

When using undiluted MFT, a higher concentration of flocculant was needed, for example 1000 ppm of Flocculant A, to obtain an acceptable degree of flocculation (see FIG. 2 and Table 4: Sample C). When adding the optimum initial concentration of coagulant (ferrous chloride) and oxidant ($CaO_2$) from the diluted samples, slower settling and less compaction was obtained but the same effect on supernatant clarity was observed (see FIG. 2 and Table 4: Sample C and Sample D). Table 4 presents data related to the COD and turbidity values of the latter samples, which indicated a significant reduction when the coagulant ferrous chloride and oxidant calcium peroxide were applied during flocculation.

TABLE 4

| Sample | COD (mg/L) | Turbidity (FAU) |
|---|---|---|
| A | 440 | 1170 |
| B | 162 | 41 |
| C | 1420 | 5120 |
| D | 295 | 79 |

In the preceding procedures, various steps have been described. It will, however, be evident that various modifications and changes may be made thereto, and additional procedures may be implemented, without departing from the broader scope of the exemplary procedures as set forth in the claims that follow.

The invention claimed is:

1. A method of treating tailings stream comprising adding to the tailings stream (i) at least one anionic polyacrylamide flocculant, and further adding to the anionic polyacrylamide flocculant containing tailings stream (ii) at least one oxidant, which is in the form of a solid and/or slurry, and further wherein the at least one oxidant dissolves over a prolonged time period thereby providing for prolonged oxidation and (iii) at least one iron containing coagulant, wherein the added amount(s) of the at least one oxidant which is in the form of a solid and/or a slurry and the at least one coagulant when added to the anionic polyacrylamide flocculant containing tailings stream results in a greater decrease in the chemical oxygen demand (COD) and the turbidity of the treated tailings stream compared to the decrease in COD and turbidity obtained upon the addition of the same at least one oxidant which is in the form of a solid and/or slurry, when added in the same amount to the anionic polyacrylamide flocculant containing tailing stream in the absence of the at least one coagulant.

2. The method of claim 1, wherein when the same at least one oxidant which is in the form of a solid and/or slurry, when added to the tailings in the same amount in the absence of the at least one coagulant elicits no significant effect on COD.

3. The method of claim 1, wherein when the same at least one oxidant which is in the form of a solid and/or slurry, when added to the tailings in the same amount in the absence of the at least one coagulant elicits no significant effect on turbidity.

4. The method of claim 1, wherein the combined dosage of the at least one coagulant and the at least one oxidant which is in the form of a solid and/or slurry, when added to the tailings elicits an additive or synergistic effect on the removal of toxic contaminants and/or promotes the breakdown of polymers and polymer/flocs added and produced during flocculation.

5. The method of claim 1, wherein the at least one iron containing coagulant comprises ferrous chloride, ferric chloride, ferrous sulfate, ferric sulfate, and/or polyferric sulphate.

6. The method of claim 5, wherein the at least one coagulant comprises ferrous chloride.

7. The method of claim 1, wherein the at least one oxidant which is in the form of a solid and/or slurry, when added to the tailings comprises a peroxide-containing compound.

8. The method of claim 1, wherein the at least one oxidant which is in the form of a solid and/or slurry, comprises calcium peroxide, magnesium peroxide, a persulfate anion, sodium percarbonate, permanganate, and/or hypochlorite.

9. The method of claim 1, wherein the at least one oxidant which is in the form of a solid and/or slurry, comprises calcium peroxide.

10. The method of claim 1, wherein the at least one coagulant comprises ferrous chloride, ferric chloride, ferrous sulfate, ferric sulfate, and/or polyferric sulphate and the at least one oxidant which is in the form of a solid and/or slurry, comprises calcium peroxide, magnesium peroxide, a persulfate anion, sodium percarbonate, permanganate, and/or hypochlorite.

11. The method of claim 1, wherein the added dosages of the at least one coagulant and the at least one oxidant, which is in the form of a solid and/or slurry, comprise amounts which in combination provide for a maximum decrease in the turbidity and COD of the treated tailings stream.

12. The method of claim 11, wherein the at least one oxidant which is in the form of a solid and/or slurry, is calcium peroxide and the added dosage is at least 80 ppm and the at least one coagulant comprises ferrous chloride and the added dosage is at least 170 ppm.

13. The method of claim 1, wherein the at least one oxidant, which is in the form of a solid and/or slurry, and the at least one coagulant are added to a mature tailings stream after the addition of the at least one anionic polyacrylamide flocculant.

14. The method of claim 1, wherein the at least one oxidant, which is in the form of a solid and/or slurry, and the at least one coagulant are added in combination to a mature tailings stream after the addition of the at least one anionic polyacrylamide flocculant.

15. The method of claim 1, wherein combined treatment of said tailings stream with said at least one oxidant, which is in the form of a solid and/or slurry, and the at least one coagulant results in a reduction of chemical oxygen demand ("COD") to 300 mg/L or less.

16. The method of claim 1, wherein combined treatment of said tailings stream with said at least one oxidant, which is in the form of a solid and/or slurry, and the at least one coagulant results in a reduction of chemical oxygen demand ("COD") to 200 mg/L or less.

17. The method of claim 1, wherein treatment of said tailings stream with said at least one oxidant, which is in the form of a solid and/or slurry, when added to the tailings in combination with the at least one coagulant results in a treated tailings stream having a turbidity of 150 FAU or less.

18. The method of claim 1, wherein treatment of said tailings stream with said at least one oxidant, which is in the form of a solid and/or slurry, when added to the tailings in combination with the at least one coagulant results in a treated tailings stream having a turbidity of 100 FAU or less.

19. The method of claim 1, wherein treatment of said tailings stream with said at least one oxidant, which is in the form of a solid and/or slurry, when added to the tailings in combination with the at least one coagulant results in a treated tailings stream having a turbidity of 50 FAU or less.

20. The method of claim 1, wherein said at least one oxidant is added in solid form to said tailings.

21. The method of claim 1, wherein said at least one oxidant is added in the form of a slurry to said tailings.

22. A method of treating tailings stream comprising adding to the tailings stream:

(a) at least one anionic polyacrylamide flocculant, and further adding to the anionic polyacrylamide flocculant containing tailings stream, (b) at least one solid oxidant which is in the form of a solid and/or slurry, such that when added to the tailings it dissolves over a prolonged duration thereby providing for the prolonged release of peroxides, and (c) at least one iron containing coagulant, wherein:

(i) the at least one coagulant comprises ferrous chloride, (ii) the at least one oxidant which is in the form of a solid and/or slurry, comprises calcium peroxide, and (iii) the added amount(s) of the ferrous chloride and the calcium peroxide, when added to the anionic polyacrylamide flocculant containing tailings stream results in the prolonged release of peroxides as the calcium peroxide dissolves over a prolonged time period thereby providing for the prolonged oxidation of the treated tailings stream, and further wherein the combination of (i) and (ii) results in a greater decrease in the chemical oxygen demand (COD) and the turbidity of the treated tailings stream compared to the decrease in COD and turbidity obtained upon the addition of the calcium peroxide in the same amount to the anionic polyacrylamide flocculant containing tailing stream in the absence of the at least one coagulant.

23. The method of claim 22, wherein said calcium peroxide oxidant is added in solid form to said tailings.

24. The method of claim 22, wherein said calcium peroxide oxidant is added in the form of a slurry to said tailings.

* * * * *